United States Patent [19]

Wintrell

[11] 3,955,968

[45] May 11, 1976

[54] METHOD FOR DETERMINING THE TEMPERATURE OF A MOLTEN METAL BATH

[75] Inventor: Reginald Wintrell, Gibsonia, Pa.

[73] Assignee: Koppers Company, Inc., Pittsburgh, Pa.

[22] Filed: Jan. 10, 1975

[21] Appl. No.: 540,125

Related U.S. Application Data

[63] Continuation-in-part of Ser. No. 153,402, June 15, 1971, abandoned, which is a continuation of Ser. No. 792,643, Jan. 21, 1969, abandoned.

[52] U.S. Cl. ..... 75/60; 75/51; 23/230 PC

[51] Int. Cl.[2] ..... C21C 7/00

[58] Field of Search ..... 75/60, 59, 52, 51; 23/230 R, 230 PC

[56] References Cited

UNITED STATES PATENTS

| | | | |
|---|---|---|---|
| 3,463,631 | 8/1969 | Vayssiere et al. | 75/60 |
| 3,475,599 | 10/1969 | Schwartzenberg et al. | 75/60 |
| 3,489,518 | 1/1970 | Revell et al. | 23/230 R |
| 3,500,029 | 3/1970 | Schwartzenberg et al. | 75/60 |

OTHER PUBLICATIONS

Daniels, F.; *Outlines of Physical Chemistry;* New York, 1948 pp. 124–129.

Hougen, O.; *Chemical Process Principles* (I): *Material and Energy Balances;* New York, 1947, pp. 302–311, (TP155 H65).

*Primary Examiner*—Walter R. Satterfield
*Attorney, Agent, or Firm*—Stanley J. Price, Jr.; Sherman H. Barber

[57] ABSTRACT

In a top blown oxygen converter, temperature of the molten metal is determined by measuring the total heat of the charge. The oxygen supplied through the lance is measured and the amount of carbon monoxide and carbon dioxide leaving the converter are continuously determined. After the conversion process has progressed and after the metalloids have been oxidized, the total amount of lance oxygen and the total amount of carbon monoxide and carbon dioxide leaving the converter are determined. The increase in temperature of the molten metal bath due to the exothermic reaction is determined by the total amounts of carbon dioxide and carbon monoxide leaving the converter. The increase in temperature of the metal bath due to the exothermic reaction is determined by subtracting from the total amount of oxygen supplied, the amount of unreacted oxygen and the amount of oxygen consumed in forming carbon monoxide, carbon dioxide and oxidized iron. The oxygen remaining by difference is consumed in the conversion of the metalloids to their oxides and the increase in temperature is determined by multiplying the volume of oxygen used to oxidize the metalloids by the average heat of formation per unit volume of oxygen.

Subsequent increases in the temperature are determined by measuring the oxygen supplied, carbon monoxide and carbon dioxide leaving the vessel. Oxygen to oxidize carbon and oxidized iron is subtracted from the amount of oxygen supplied and the remaining oxygen, less oxygen dissolved in the bath, is considered to have reacted with the iron.

10 Claims, 2 Drawing Figures

METHOD FOR DETERMINING THE TEMPERATURE OF A MOLTEN METAL BATH

CROSS REFERENCE TO RELATED APPLICATIONS

This application is a continuation in part of copending application, Ser. No. 153,402, filed on June 15, 1971, and now abandoned, which in turn was a continuation of application Ser. No. 792,643, filed on Jan. 21, 1969 and now abandoned.

BACKGROUND OF THE INVENTION

1. Field of the Invention

This invention relates to a method for determining the temperature of a molten metal bath in a top blown oxygen converter and more particularly to a method for determining the temperature of a molten metal bath after the conversion process has progressed a predetermined period of time and thereafter determining the further increases in the temperature of the molten metal bath as the conversion process progresses to completion.

2. Description of the Prior Art

It is highly desirable in metal conversion processes, especially in top blown oxygen converters, to determine the temperature of the molten metal bath as the conversion process progresses and to predict, prior to turndown, the temperature of the molten metal bath at the completion of the conversion process. It is also highly desirable to predict and control the formation of FeO in the slag which rapidly increases during the latter stages of the conversion process.

Several proposals have been made in the past for determining the temperature of a molten metal bath in a top blown oxygen converter. For example, in U.S. Pat. No. 3,377,158, a bomb thermocouple is dropped into the molten metal bath after the conversion process has progressed for a preselected period of time. The thermocouple measures the temperature of the molten metal bath at the time of the conversion process when it is dropped into the molten metal bath and is used as the initial measured temperature for subsequent temperature determinations. The final temperature of the molten metal bath at the end of the conversion process is determined by adding to the initial measured temperature of the bath, the temperature increase attributable to the oxygen consumed in the conversion process. The accuracy of the calculated temperature at turndown is dependent on the accuracy of the initial measured temperature by the thermocouple.

It is well known that there is a temperature gradient within molten metal bath with the highest temperature in the jet oxygen-hot metal reaction zone. It is also feasible that the slag formed during the conversion process is at a differential temperature to that of the molten metal. These factors affect the accuracy of determining an accurate initial measured temperature and therefore, also affect the accuracy of the calculated temperature at turndown.

Another proposed procedure for determining the temperature of the bath is disclosed in U.S. Pat. No. 3,489,518, granted on Jan. 13, 1970, and entitled "Carbon Determination Method And Apparatus". In this process, the amount of carbon in the charge material is first determined and the other constituents of the charge are also conventionally sampled and analyzed for heat release determination. The increase in the temperature of the molten metal bath attributable to the oxidation of the metalloids is determined by calculating the heat of formation of each of the metalloids and the heat of formation of the gaseous carbon compounds. One of the inherent deficiencies in this method is the necessity of accurately sampling prior to analyzing the charge for the metalloid constituents. An error in the sampling or analysis of one of the metalloids results in a temperature error equivalent to the error in the weight of metalloid multiplied by the heat of formation of the particular metalloid.

SUMMARY OF THE INVENTION

According to the present invention, the temperature of the molten metal bath is determined by measuring the total amount of lance oxygen fed to the converter, the portion of the lance oxygen that is converted to oxides of carbon, the portion of the lance oxygen that is converted to oxides of metalloids and the portion of the lance oxygen used to oxidize the iron in the dust. The heat added to the molten metal bath by the oxidation of the carbon is determined from the heat of formation of the carbon containing gases and the heat added by the oxidation of the metalloids is determined from the average heat of formation per unit volume of oxygen to convert the metalloids to their oxides. At a preselected time during the conversion process, after substantially all of the metalloids have been oxidized, the temperature of the molten metal bath is determined from the total heat added to the molten metal bath by the oxidation of the metalloids and the heat added to the bath by the oxidation of the portion of the carbon during the conversion process up to the preselected time.

After the conversion process has progressed beyond the oxidation of the metalloids, the further increase in the temperature of the molten metal bath is determined from the portion of the lance oxygen that is subsequently converted to oxides of carbon in a similar manner. During the latter stages of the conversion process, the increasing volume of oxygen that reacts with the iron to form FeO is measured and the heat added to the molten metal bath by the FeO formation is determined. With the above information, the increasing weight of the slag in the molten metal bath and the decreasing weight of the molten bath may also be determined.

To determine the temperature of the molten metal bath in accordance with the present invention, all that is required is to determine the heat content of the charge, the amount of oxygen fed to the converter and a continuous analysis of the gases evolved during the conversion process. The present invention eliminates the necessity of making a direct temperature measurement of the molten metal bath, as by a thermocouple or the like, determining the carbon content of the charge by analysis or sampling and analyzing the hot metal fed to the converter.

DESCRIPTION OF THE PREFERRED EMBODIMENT

In order to practice the hereinafter described process, it is necessary to have gas analyzers capable of measuring the constituents of the waste gas and to transmit this information to a computer. The computer is suitably programmed to determine from the waste or "off" gas in the flue, the composition of the gas leaving the converter before it is admixed and combusted with infiltrating air. Other instrumentation is necessary to determine the rate of flow of oxygen through the lance, and the weight, temperature and analysis of the charge. Suitable apparatus for analyzing the waste or "off" gas for determining the gases leaving the vessel is disclosed and described in U.S. Pat. No. 3,489,518, entitled "Carbon Determination Method and Apparatus" and is incorporated herein by reference. It should be understood, however, that other apparatus may be employed to analyze the gases and transmit this information to a computer.

All temperature calculations are preferably taken at a base temperature of 2,900°F. and it will be hereinafter assumed that the heat content of the various constituents at 2,900°F. is zero, although any base temperature, such as ambient, may be employed.

To determine the temperature of the molten metal bath, the total heat content of the charge, QCHARG, is first determined from a summation of the heat content of each of the constituents of the charge according to the following:

$$Q\ CHARG = QHM + QS + QCIC + QLCM + Q\ DLC + QSPCM + QSTC \quad (I)$$

Where QHM is the heat content of the hot metal; QHM is determined by the temperature and weight of the hot metal introduced into the converter; QS is the heat content of the scrap; QCIC is the heat content of the cold iron and QLCM the heat content of the lime in the charge; Q DLC is the heat content of the dolomite in the charge and QSPCM is the heat content of the spar in the charge and QSTC is the heat content of the stone in the charge. QS; QCIC; QLCM; QDLC; QSPCM and QSTC are determined by the weight and temperature of the constituents introduced into the converter.

Figure 1:
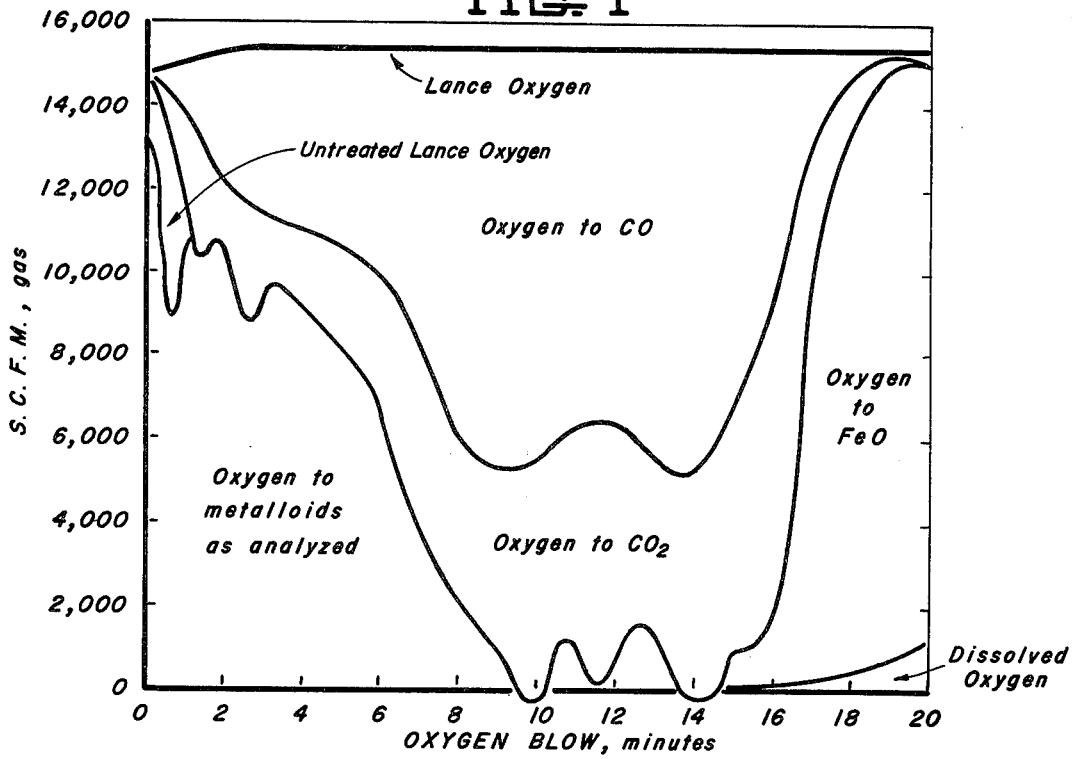
FIG. 1 is a graphical illustration of the amount of oxygen supplied to the converter by the oxygen lance and that portion of the lance oxygen that reacts with the carbon to form carbon containing gases and the portion that reacts with the metalloids to form metalloid oxides and the portion of the oxygen that reacts with the iron to form FeO.
Figure 2:
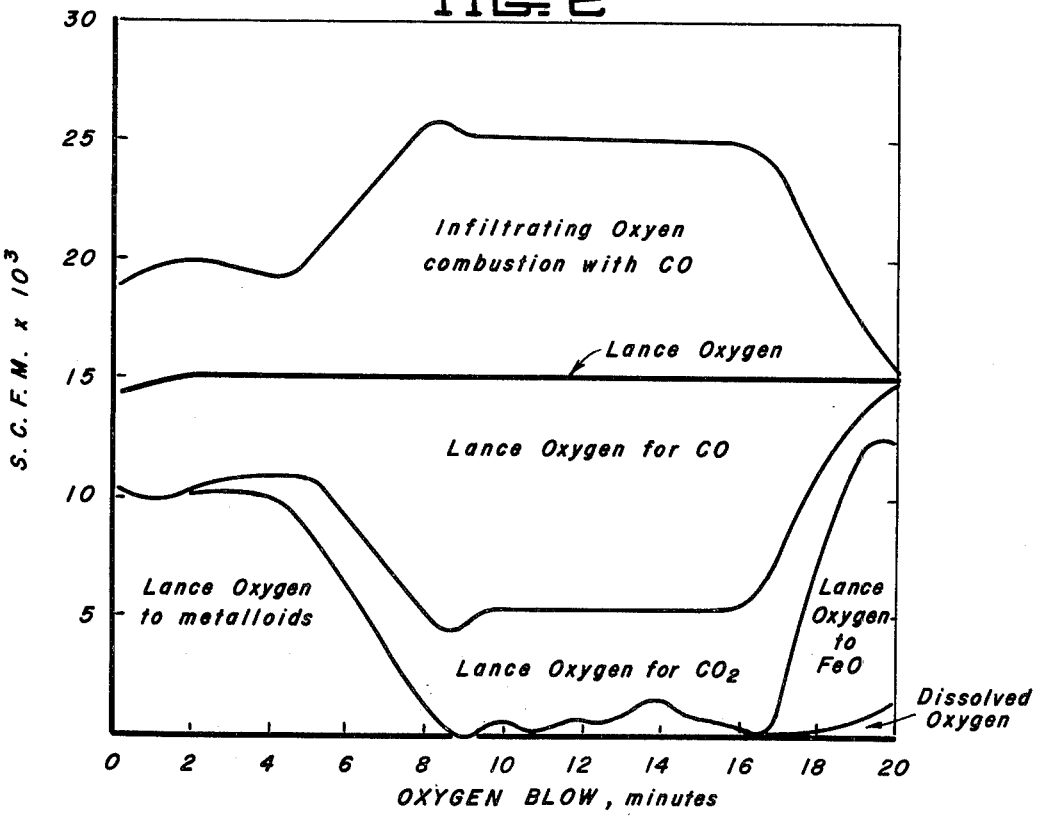
FIG. 2 is another graphical illustration of the conversion of the lance oxygen to the carbon containing gases, metalloid oxides and FeO and that required portion of the oxygen that infiltrates with the air into the flue to convert the carbon monoxide to carbon dioxide in the flue.

After the total heat content of the charge, calculated from a base of 2,900°F., is determined, the material is charged into a top blown oxygen converter and an oxygen lance is lowered into the converter. The conversion process is initiated by supplying oxygen through the lance into the charge within the converter. The rate of flow of oxygen through the lance is maintained relatively constant at, for example, as illustrated in FIGS. 1 and 2, a rate of 15,000 SCFM. The rate of flow of oxygen is continually measured and this information is transmitted to the computer.

The waste or "off" gas from the converter is continually measured from the beginning of the conversion process and this information is periodically supplied to a computer. The computer, from the composition of the waste gas in the flue, determines through a suitable program, the volume and composition of the gases leaving the converter before the gases are admixed with the air of infiltration. The gases leaving the converter during the conversion process, where substantially all of the oxygen fed by the lance reacts with the materials in the molten metal bath, consists of carbon monoxide and carbon dioxide. A substantial portion or at times, all of the carbon monoxide after leaving the vessel combines with the oxygen of the infiltrating air and is converted to carbon dioxide. The periodically measured amounts of carbon monoxide and carbon dioxide leaving the vessel and the periodically measured amounts of oxygen supplied through the lance are continually summated and recorded by the computer.

After the conversion process has progressed for a sufficient period of time for the metalloids, i.e. silicon, manganese, phosphorus, cobalt, titanium and the like, to be oxidized, the summated amount of oxygen supplied through the lance and the summated amounts of carbon monoxide and carbon dioxide in the gases leaving the converter are determined. As is illustrated in FIGS. 1 and 2, after a conventional conversion process has progressed for a period of about 10 minutes, with due allowance for oxidized iron, substantially all of the lance oxygen is converted to carbon monoxide and carbon dioxide and substantially all of the metalloids have been oxidized so that little, if any oxygen is being consumed after the conversion process has progressed for a period of 10 minutes for the oxidation of the metalloids.

For convenience, the time at which the temperature of the bath is determined after the metalloids have been oxidized will be designated as Time 'T'. A heat balance for the conversion process at Time 'T' may be expressed as follows.

$$Q\ REACTT + Q\ CHARG + Q\ TRIMT = 0 \quad (II)$$

Where Q REACTT is the total heat of reaction within the metal at time 'T' and is determined by equation (XI) later explained. Q CHARG is the heat content of the charge as introduced into the vessel and Q TRIM T is the heat energy either added to or taken from the molten metal by various factors associated with the conversion process.

Q TRIMT includes factors not materially dependent on the time at which determined and are summated as Q TRIMS. Other factors that are dependent on the time during the blow at which they are measured are summated as Q TRIM V.

$$Q\ TRIMT = Q\ TRIM\ S + Q\ TRIM\ V \quad (III)$$

It has been found that Q TRIM S includes thermal heat losses, heat losses from metal slopping, heat losses from heat of fumes and heat retained in the vessel from previous heats. Q TRIM S is determined by $$Q\ TRIM\ S = Q\ NET + Q\ SLP + Q\ FUME + Q\ RET \quad (IV)$$

where Q TRIM S is the summated heat loss caused by net thermal loss (Q NET), heat losses from metal slopping (Q SLP), heat losses from fume (Q FUME) and the heat retained in the vessel (Q RET). It has been determined that Q TRIM S has a substantially constant value as, for example, −10,000,000 BTUs for a particular furnace.

Q TRIM V includes the heat required to elevate the temperature of the lance oxygen to the base temperature at time 'T', the heat leaving with the carbon gases at time 'T', the heat content of the bath at time 'T' and the heat content of the slag at time 'T' and is determined by the following equation:

$$Q\ TRIM\ V = Q02TT - Q\ GASTT - Q\ BTT - Q\ SLGTT \quad (V)$$

Q02TT, the heat required to elevate the total amount of lance oxygen supplied to the converter to the base temperature to time 'T' is determined from the following relationship $$Q02TT = -63.2\ \epsilon LO \quad (VI)$$

where $\epsilon$LO is the summated amount of lance oxygen fed to the converter from the beginning of the conversion process to the time 'T' and −63.2 is a constant.

Q GASTT is the heat lost with the carbon gases leaving the converter and is determined by $$Q\ GASTT = -4.53\ \epsilon VCOLV - 7.5\ \epsilon VCO2LV \quad (VII)$$

where $\epsilon$VCOLV is the summated total volume of carbon monoxide gas leaving the converter and $\epsilon$VCO2LV is the summated volume of carbon dioxide leaving the converter to time 'T'.

Q BTT is the heat content of the bath at time 'T' and is determined by $$Q\ BTT = WBTT\ (AB + BBX) \quad (VIII)$$

where WBTT is the weight of the molten metal bath at time 'T' and is determined by equation XXVII, later explained, AB is an additive constant of the bath and BB is a temperature coefficient of the bath and X is the temperature of the bath at time 'T'.

Q SLGTT, the heat content of the slag, is determined by $$Q\ SLGTT = WSLGTT\ (X - 2{,}900) \times SHSLG \quad (IX)$$

where WSLGTT is the total weight of the slag at time 'T' and X is the temperature of the molten metal at Time 'T', 2,900 is the base temperature and SHSLG is the specific heat of the slag.

Combining equations IV, VI, VII, VIII AND IX, the QTRIMT may be expressed as follows:

$$Q\ TRIMT = -10{,}000{,}000 - 63.2\ \epsilon LO + 4.53\ \epsilon VCOLV + 7.5\ \epsilon VCO2LV - WBTT\ (AB + BBX) - WSLGTT\ (X - 2{,}900)\ SHSLG$$

Q REACTT, the total heat of reaction within the metal at time 'T' is determined by the equation $$Q\ REACTT = Q\ REACT\ S + Q\ REACT\ V \quad (XI)$$

where:

$$Q\ REACTS = QO_2M + Q\ F_3Fe + Q\ F_2Fe + Q\ F1Fe + Q\ CALCC + Q\ CALMC + Q\ H2OB \quad (XII)$$

and $$Q\ REACT\ V = Q\ O2BT + Q\ CLTT + Q\ DUST + QMXSTT + QFeO \quad (XIII)$$

The variables in Q REACTS are QO2M, the heat released by metalloids, Q $F_3Fe$, the heat of reduction of $Fe_3O_4$; $QF_2Fe$, the heat of reduction of $Fe_2O_3$; Q F1Fe the heat of reduction of FeO, QCALCC, the heat of calcination of calcium carbonate; Q CALMC, the heat of calcination of magnesium carbonate and QH2OB, the heat of vaporization of water

Q02M, the heat released by the metalloids other than carbon, is determined by $$QO2M\ Q02M\ AVHFM \times VO2M \quad (XIV)$$

where VO2M is the volume of oxygen that reacts with the metalloids to convert the metalloids to their oxides and AVHFM is the average heat of formation of all of the metalloids in the charge. VO2M is determined from the relation of the oxygen supplied to the vessel through the lance and the composition of the waste gases evolved and is determined by the following equation:

$$VO2M = \Sigma LO - \Sigma VCO2WG - \Sigma V02WG - \frac{\Sigma VCOWG}{2} + VO2IN - 0.05\ \Sigma VCO2WG - \Sigma VO2DA \quad (XV)$$

where LO is the flow rate of the lance oxygen, VCO2WG is the flow rate of the carbon dioxide in the waste gas, V02WG is the flow rate of the oxygen in the waste gas, VCOWG is the flow rate of the carbon monoxide in the waste gas, VO2IN is the flow rate of oxygen by air infiltration and VCO2WG is the flow rate of the carbon dioxide in the waste gas and VO2DA is the flow rate of oxygen from air infiltration converted to dust.

The heat of reduction of $Fe_3O_4$ to Fe is determined by $$QF3Fe = (WF3S + WF3Cl) \times FFEF3 \quad (XVI)$$

where WF3S is the weight of the $Fe_3O_4$ from scrap, WF3Cl is the weight of $Fe_3O_4$ from the cold iron and FFEF3 is the heat of reduction of Fe per pound of $Fe_3O_4$ at 2,900°F.

The heat of reduction of $Fe_2O_3$ to Fe is determined by $$QF2Fe = (WF2FC + WF2FA) \times FFEF2 \quad (XVII)$$

where WF2FC is the weight of the $Fe_2O_3$ from charge and WF2FA is the weight of the $Fe_2O_3$ from additions and FFEF2 is the heat of reduction of Fe per pound of $Fe_2O_3$ at 2,900°F.

The heat of reduction of FeO to Fe is determined by $$QF1Fe = (WF1FC + WF1FA) \times FFEF1 \quad (XVIII)$$

where WF1FC is the weight of the FeO from the charge and WF1FA is the weight of the FeO from additions and FFEF1 is the heat of reduction of Fe per pound of FeO at 2,900°F.

$$Q\ CALCC = WCCFC + WCCFA \times F\ CALCC \quad (XIX)$$

where WCCFC is the weight of the calcium carbonate from the charge, WCCFA is the weight of the calcium carbonate from additions and F CALCC is the heat of calcination of CaO per pound of calcium carbonate at 1,623°F.

$$C\ CALMC = (WMCFC + WMCFA) \times FCALMC \quad (XX)$$

where WMCFC is the weight of $MgCO_3$ from charge and WMCFA is the weight of the $MgCO_3$ from additions and FCALMC is the calcination of MgO per pound of $MgCO_3$.

$$Q\ H20B = WH20B\ (AH20 + BH20 \times THM) \qquad (XXI)$$

where WH20B is the weight of the water vaporized, AH20 is an additive constant and BH20 is a temperature coefficient constant and THM is the temperature of the hot metal.

The factors of Q REACT V as expressed in equation XIII are determined as follows:

$$QO\ 2BT = \frac{0.0031 \times WBTT \times FSOLO2}{CCBT} \qquad (XXII)$$

where Q02BT is the heat of oxygen in solution and WBTT is the weight of the bath at time 'T', and FSOLO 2 is the heat of solution of oxygen in iron and CCBT is the carbon content of the molten metal bath at time 'T'.

The summated heat release from carbon QCLTT is determined by $$QCLTT = 0.0316\ \epsilon VCOLV \times FCOC + 0.0316\ \epsilon VCO2LV \times FCO2C \qquad (XXIII)$$

where FCOC is the heat of formation of carbon monoxide per pound carbon and FCO2C is the heat of formation of carbon dioxide per pound carbon and VCOLV is volume flow rate of carbon monoxide from the vessel and VCO2LV is volume flow rate of carbon dioxide from the vessel.

Q DUST, which is the heat carried away with the dust, is determined by the equation $$Q\ DUST = 30\ \epsilon VCO2WG \qquad (XXIV)$$

where VCO2WG is the flow rate of carbon dioxide in the waste gas and 30 is the conversion constant.

QMXSTT is the total heat release in the slag to time 'T' and is determined by $$QMXSTT = WSLGTT \times FMXSI \qquad (XXV)$$

where WSLGTT is the total weight of the slag at time 'T' and FMXSI is the heat release per pound of slag.

QFeO, the heat release in FeO formation is determined by $$QFeO = 604\ VO2Fel \qquad (XXVI)$$

where VO2Fel is the volume of oxygen to form FEO in the slag and 604 is a conversion constant.

WBTT, the weight of the molten metal bath at time 'T' is determined from the following equation:

$$WBTT = WHM + WS - WSILT - WMNLT - WPLT - WCRLT - WTILT - WSLT - 0.276VO2Fel - 0.018\ \epsilon VCO2WG - 0.0316\ \epsilon VCO2WG - 0.0316\ \epsilon VCOWG \qquad (XXVII)$$

where WHM is the weight of the hot metal, WS is the weight of the scrap and WSILT is the weight of the silicon leaving the metal bath, WMNLT is the weight of the manganese leaving the metal bath, WPLT is the weight of the phosphorus leaving the metal bath, WCRLT is the weight of the chrome leaving the metal bath, WTILT is the weight of the titanium leaving the metal bath, WSLT is the weight of the sulphur leaving the bath, 0.276 VO2Fel is the iron loss to the slag and 0.018 εVCO2WG is the iron loss to dust, 0.0316 εVCO2WG is the carbon loss as carbon dioxide and 0.0316 εVCOWG is the carbon loss as carbon monoxide.

VO2Fel is the volume of oxygen combining with iron in the bath to form the FeO in the slag and is determined as follows:

$$VO2Fel = \Sigma LO - VO2M - \Sigma VCO2WG - \frac{\Sigma VCOWG}{2} - \Sigma VO2WG - 0.05\ \Sigma VCO2WG - \frac{0.0366\ WBTT}{CBTT} - \Sigma VO2DA \qquad (XXVIII)$$

where WBTT is the weight of the molten metal bath at time 'T' and CBTT is the carbon content of the bath at time 'T'.

Solving the above for Q REACTT and substituting the elements of the QTRIMT equation in heat balance equation II and solving for X, the temperature of the bath at time 'T', the following equation is obtained:

$$X = (Q\ REACTT + Q\ CHARG - 10{,}000{,}000 - 63.2\ \epsilon LO + 4.53\ \epsilon VCOLV + 7.5\ \epsilon VCO2LV - WBTT(AB) + 2900.\ SHSLG.\ WSLGTT) \div (WBTT.BB + SHSLG.\ WSLGTT) \qquad (XXIX)$$

The weight of the slag in the bath at any time 'T' is WSLGTT and is determined by the following:

$$WSLGTT = WSLGS + 0.362\ VO2Fel \qquad (XXX)$$

where $$WSLGS = 0.977\ WLCM + 0.996\ WDLCM + 0.993\ WSPCM + 2.14\ WSILT + 1.291\ WMNLT + 1.516\ WPLT + 1.46\ WCRLT + 1.667\ WTILT$$

WLCM is the weight of lime charge and WDLCM is the weight of dolomite charged and WDPCM is the weight of flurspar charged, their respective slag constants 0.977, 0.966 and 0.933 are determined from their respective analyses.

The weight of the FeO in the slag is determined as follows:

$$WFeO = 0.362VO2\ Fel \qquad (XXXI)$$

Where it is desired to obtain the FeO percentage in the slag at time 'T', this is determined as follows:

$$\text{Percent FeO in slag} = \frac{0.362\ VO2Fel \times 100}{WSLGS + 0.362\ VO2\ Fel} \qquad (XXXII)$$

It will be apparent from the above relationship between the weights of the constituents in the charge, the amount of oxygen supplied to the bath through the lance and the amount of carbon monoxide and carbon dioxide leaving the vessel determined by the amount of carbon monoxide and carbon dioxide in the waste gas, both the temperature of the molten metal bath and the amount of FeO formed in the slag can be continuously determined after substantially all of the metalloids have been converted to their oxides.

Thus, the temperature of the molten metal bath and the amount of FeO formed in the slag can be continuously determined without any direct temperature measurement of the molten metal bath during the conversion process. This eliminates the inaccuracies that may be encountered due to inaccurate temperature measurements. The temperature may also be determined without a sampling and analysis of the hot metal either fed to the converter or in the converter during the conversion process. This eliminates the inaccuracies due to errors in metal analysis and also eliminates turndown during the conversion process. Also, the herein described process does not require an analysis of the charge for the carbon content and thus, eliminates possible errors due to inaccurate carbon analysis.

According to the provisions of the patent statutes, the principle, preferred construction and mode of operation of this invention has been illustrated and described with what is now considered to represent its best embodiment.

I claim:

1. A method for determining the heat content of a molten metal bath in a top blown oxygen converter at a preselected time during the conversion process after substantially all of the metalloids in the molten metal bath and before the completion of the conversion process without utilizing direct temperature measurement of the molten metal bath comprising, a. determining the heat content of the charge introduced into the converter without determining the carbon content of the charge, b. determining the total heat of reaction of the molten metal bath from the beginning of the conversion process to a preselected time during the conversion process after oxidation of substantially all of the metalloids in the molten metal bath and prior to the completion of the conversion process, c. determining the total heat loss of the molten metal bath from the beginning of the conversion process to said preselected time from factors associated with the conversion process, and d. obtaining the heat content of the molten metal bath at said preselected time by summating the heat content of the charge, the total heat of reaction of the molten metal and the total heat loss from factors associated with the conversion process from the beginning of the conversion process to said preselected time during the conversion process.

2. A method for determining the heat content of a molten metal bath in a top blown oxygen converter at said preselected time during the conversion process as set forth in claim 1 which includes, a. determining the heat content of the hot metal, b. determining the heat content of the scrap, c. determining the heat content of the cold iron, d. determining the heat content of the lime in the charge, e. determining the heat content of the dolomite in the charge, f. determining the heat content of the spar in the charge, g. determining the heat content of the stone in the charge, h. determining from the foregoing determinations the heat content of the charge from the expression $$QCHARG = QHM + QS + QCIC + QLCM + QDLC + QSPCM + QSTC$$

QCHARG = the heat content of the charge,
QHM = the heat content of hot metal,
QS = the heat content of the scrap,
QCIC = the heat content of the cold iron,
QLCM = the heat content of the lime in the charge,
QDLC = the heat content of the dolomite in the charge,
QSPCM = the heat content of the spar in the charge,
QSTC = the heat content of the stone in the charge.

3. A method for determining the heat content of a molten metal bath in a top blown oxygen converter at said preselected time during the conversion process as set forth in claim 1 which includes, a. determining the net thermal loss in the vessel, b. determining the heat loss from metal slopping, c. determining the heat loss from fumes, d. determining the heat retained in the vessel from the previous conversion process, e. determining from a base temperature the heat required to elevate total amount of lance oxygen supplied to the converter from the beginning of the conversion process to said preselected time, f. determining from a base temperature the heat lost with the carbon gases leaving the converter from the beginning of the conversion process to said preselected time, g. determining the weight of the molten metal bath at said preselected time, h. determining the heat content of the molten metal bath at said preselected time, i. determining the heat content of the slag at said preselected time, and j. obtaining the heat losses of the molten metal bath from the beginning of the conversion process to said preselected time from factors associated with said conversion process from the expression $$Q\ TRIM\ T = Q\ NET + Q\ SLP + Q\ FUME + QO2TT - Q\ GASTT - QBTT - QSLGTT$$

where:

Q TRIM T = the total heat loss of the molten metal bath from the beginning of the conversion process to said preselected time from factors associated with the conversion process,
Q NET = net thermal loss,
Q SLP = heat loss from metal slopping,
Q FUME = heat loss from fumes,
Q RET = heat retained in the vessel from previous conversion processes,
Q O2TT = Heat required to elevate the total amount of lance oxygen supplied to the converter to the base temperature,
Q GASTT = heat lost with the carbon gases leaving the converter,
Q BTT = heat content of the bath at said predetermined time where QBTT is determined from the expression $$QBTT = WBTT\ (AB + BBX)$$

where

WBTT = weight of the molten metal bath at said predetermined time, AB = constant BB = constant X = the temperature of the bath at said predetermined time, and Q SLGTT = heat content of the slag at said predetermined time.

4. A method for determining the heat content of a molten metal bath in a top blown oxygen converter at said preselected time during the conversion process as set forth in claim 1 which includes, a. determining the amount of lance oxygen fed to the converter from the beginning of the conversion process to said preselected time, b. determining the total volume of carbon monoxide leaving the converter from the beginning of the conversion process to said preselected time, c. determining the weight of the molten metal bath, d. determining the temperature of the molten metal bath, e. determining the weight of the slag in the molten metal bath at said preselected period of time, f. from the foregoing determinations determining the total heat loss of the molten metal bath from the beginning of the conversion process to said preselected time from factors associated with the conversion process from the expression $$Q\ TRIM\ T = -10{,}000{,}000 + QO2TT - Q\ GASTT - Q\ BTT - Q\ SLGTT$$

where:

Q TRIM T = the total heat loss from factors associated with the conversion process,

QO2TT = the heat required to elevate the total amount of lance oxygen supplied to the converter to the base temperature and is determined from the expression $$QO2tt = -63.2\ LO$$

where:

LO = summated amount of lance oxygen fed to the converter from the beginning of the conversion process to time 'T', −63.2 = conversion constant Q GASTT = heat lost from carbon gases leaving the converter and is determined from the following expression $$Q\ GASTT = -4.53\ VCOLV - 7.5\ VCO2LV$$

where:

VCOLV = summated total volume of carbon monoxide,

VCO2LV = summated volume of carbon dioxide,

−4.53 = conversion constant for carbon monoxide,

−7.5 = conversion constant for carbon dioxide,

QBTT = heat content of the molten metal bath at said predetermined time and is determined from the expression $$QBTT = WBTT\ (AB + BBX)$$

where:

ABTT = weight of the molten metal at said predetermined time

AB = constant

BB = constant

X = temperature of the molten metal bath at said predetermined time

QSLGTT = heat content of the slag at said preselected time and is determined from the expression $$Q\ SLGTT = WSLGTT\ (X - 2{,}900) \times SHSLG$$

where:

WSLGTT = total weight of the slag at said predetermined time,

X = temperature of the molten metal at said predetermined time, 2,900°F = base temperature, SHSLG = specific heat of the slag.

5. A method for determining the heat content of a molten metal bath in a top blown oxygen converter at said preselected time during the conversion process as set forth in claim 1 which includes, a. determining the heat released by the metalloids, b. determining the total heat of reduction of $Fe_3O_4$ to Fe in the molten metal bath, c. determining the total heat of reduction of $Fe_2O_3$ to Fe in the molten metal bath, d. determining the total heat of reduction of FeO in the molten metal bath, e. determining the total heat of calcination of calcium carbonate, f. determining the total heat of calcination of magnesium carbonate, g. determining the total heat of vaporization of water, h. determining the heat of oxygen in solution, i. determining the heat release from the carbon converted to carbon monoxide and carbon dioxide, j. determining the heat removed with the dust during the conversion process, k. determining the heat released in the slag from the beginning of the conversion process to said preselected time, l. determining the heat released in the formation of FeO in the slag, and m. determining the heat of reaction of the molten metal bath from the beginning of the conversion process to said preselected time during the conversion process from the expression $$Q\ REACTT = QO2M + QF3Fe + QF2Fe + QF1Fe + Q\ CALCC + QCALMC + QH_2OB + QO2BT + QCLTT + QDUST + QMXSTT + QFeO$$

where

Q REACTT = total heat of reaction of the molten metal bath from the beginning of the conversion process to said preselected time during the conversion process,

QO2M = heat released by the metalloids,

QF3Fe = heat of reduction of $Fe_3O_4$ to Fe, $QF_2Fe$ = heat of reduction of $Fe_2O_3$ to Fe,

QF1Fe = heat of reduction of FeO to Fe,

QCALCC = heat of calcination of calcium carbonate,

QCALMC = heat of calcination of magnesium carbonate,

QH2OB = heat of vaporization of water,

QO2BT = heat of oxygen in solution,

QCLTT = heat released by conversion of carbon to carbon monoxide and carbon dioxide, QDUST = heat removed from said converter as dust, QMXSTT = heat release in the slag from beginning of the conversion process to said preselected time, QFeO = heat release in the formation of FeO.

6. A method for determining the heat content of a molten metal bath in a top blown oxygen converter at said preselected time during the conversion process as set forth in claim 5 which includes, a. determining the volume of oxygen that reacts with the metalloids to convert the metalloids to their oxides, and b. determining from the foregoing determination the heat released by the metalloids other than carbon from the expression $$QO2M = AVHFM \times VO2M$$

where:

QO2M = heat released by the metalloids,

AVHFM = average heat of formation of the metalloids in the charge per unit volume of oxygen, VO2M = the volume of oxygen that reacts with the metalloids to convert the metalloids to their oxides.

7. A method for determining the temperature of a molten metal bath in a top blown oxygen converter at a preselected time during the convertion process after oxidation of substantially all of the metalloids in the molten metal bath and before the completion of the conversion process without utilizing direct temperature measurement of the molten metal bath comprising, a. determining the heat content of the charge introduced into the converter without determining the carbon content of the charge, b. determining the heat of reaction of the molten metal bath from the beginning of the conversion process to a preselected time during the conversion process after oxidation of substantially all of the metalloids in the molten metal bath and prior to the completion of the conversion process, c. determining the amount of lance oxygen fed to the converter from the beginning of the conversion process to said preselected time, d. determining the total volume of carbon monoxide leaving the converter from the beginning of the conversion process to said preselected time during the conversion process, e. determining the volume of carbon dioxide leaving the converter from the beginning of the conversion process to a preselected time during the conversion process, f. determining the weight of the molten metal bath at said preselected time during the conversion process, g. determining the weight of the slag in the converter at said preselected time, and h. determining from the foregoing determinations the temperature of the molten metal bath at said preselected time from the expression $$X = [Q\ REACTT + CHARG - 10{,}000{,}000 - 63.2\ \epsilon LO + 4.53\ \epsilon VCOLV + 7.5\ \epsilon VCO2LV - WBTT\ (AB) + 754\ WSLGTT] \div (WBTT.BB + SHSLG\ WSLGTT),$$

where:

X = temperature of the molten metal bath at said predetermined time,

Q REACTT = total heat of rection of the molten metal bath from the beginning of the conversion process to said preselected time during the conversion process, Q CHARG = heat content of the charge introduced into the converter, $\epsilon$LO = total volume of lance oxygen fed to the converter from the beginning of the conversion process to said preselected time, $\epsilon$VCOLV = total volume of carbon monoxide leaving the converter from the beginning of the conversion process to said preselected time, $\epsilon$VCO2LV = total volume of carbon dioxide leaving the converter from the beginning of the conversion process to said preselected time, WBTT = weight of the molten metal bath at said preselected time, AB = constant, WSLGTT = weight of the slag at said preselected time, BB = constant.

8. A method for determining the percent FeO in the slag in a top blown oxygen converter at a preselected time during the conversion process after oxidation of substantially all of the metalloids in the molten metal bath and before the completion of the conversion process without sampling and analysis of the hot metal in the charge comprising, a. determining the total volume of lance oxygen fed to the converter from the beginning of the conversion process to said preselected time during the conversion process after oxidation of substantially all of the metalloids in the molten metal bath and prior to the completion of the conversion process, b. determining the amount of lance oxygen that reacts with the metalloids to convert the metalloids to their oxides, c. determining the total volume of carbon dioxide in the waste gas, d. determining the total volume of carbon monoxide in the waste gas, e. determining the total volume of unreacted oxygen in the waste gas from the air of infiltration, f. determining the volume of oxygen associated with the oxidized iron in the dust, g. determining the total volume of oxygen dissolved in the bath, h. determining the toal volume of oxygen from the air of infiltration converted to dust, i. determining the weight of the molten metal bath at said preselected period of time during the conversion process, j. determining the carbon content of the molten metal bath at said preselected period of time during the conversion process, k. determining the weight of the slag, and l. determining from the foregoing determinations the percent FeO in the slag at said preselected time during the conversion process from the expression $$\text{Percent FeO in slag} = \frac{0.362\ VO2Fel \times 100}{WSLGS + 0.362\ VO2\ Fel}$$

where:

VO2Fe1 = the volume of oxygen combining with the iron in the bath to form FeO in the slag and is determined from the expression $$VO2Fel = \Sigma LO - VO2M - \Sigma VCO2WG - \frac{\Sigma VCOWG}{2} - \Sigma VO2WG - 0.05\ \Sigma VCO2WG - \frac{0.0366\ WBTT}{CBTT} - \Sigma VO2DA$$

where:

$\epsilon$LO = total volume of the lance oxygen supplied to the converter from the beginning of the conversion process to said preselected time during the conversion process, VO2M = volume of the lance oxygen that reacts with the metalloids to convert the metalloids to their oxides, $\epsilon$VO2WG = total volume of carbon monoxide in the waste gas from the beginning of the conversion process to said preselected time during the conversion process, $\epsilon$VCOWG = total volume of carbon monoxide in the waste gas, $\delta$VO2WG = total volume of unreacted oxygen in the waste gas, WBTT = weight of the bath at said preselected time, CBTT = the carbon in the bath at said preselected time, $\epsilon$VO2DA = total oxygen from air of infiltration converted to dust, and WSLGS = weight of the slag at preselected time during the conversion process.

9. A method for determining the heat released by the metalloids in a top blown oxygen converter during the conversion process after oxidation of substantially all of the metalloids in the molten metal bath and before completion of the conversion process without sampling and analysis of the hot metal in the charge comprising, determining the average heat of formation of the metalloids in the charge per unit volume of oxygen, determining the volume of oxygen that reacted with the metalloids, and determining from the foregoing determinations the heat released by the metalloids from the following expression:

$$QO2M = AVHFM \times VO2M$$

where:

QO2M = heat released by metalloids

AVHFM = average heat of formation of the metalloids in the charge per unit volume of oxygen, VO2M = volume of oxygen that reacted with the metalloids.

10. A method for determining the oxygen required to convert the metalloids to their oxides in a molten metal bath during the conversion process in a top blown oxygen converter as set forth in claim 9 which includes, a. determining the total volume of lance oxygen fed to the converter from the beginning of the conversion process to said preselected time during the conversion process, b. determining the total volume of carbon dioxide in the waste gas, c. determining the total volume of carbon monoxide in the waste gas, d. determining the total volume of unreacted oxygen in the waste gas from the air of infiltration, e. determining the total volume of oxygen introduced into the stack by air of infiltration, f. determining the volume of lance oxygen associated with the oxidized iron in the dust, g. determining the total volume of oxygen from the air of infiltration converted to dust, and h. continually determining from the foregoing determinations the volume of oxygen that reacted with the metalloids to convert the metalloids to their oxides from the expression $$VO2M = \Sigma LO - \Sigma VCO2WG - \Sigma VO2WG - \frac{\Sigma VCOWG}{2} + VO2IN - 0.05\,\Sigma VCO2WG - \Sigma VO2DA$$

where:

VO2M = volume of oxygen that reacted with the metalloids, $\epsilon$LO = total volume of the lance oxygen supplied to the converter from the beginning of the conversion process to said preselected time during the conversion process, $\epsilon$VCO2WG = total volume of carbon dioxide in the waste gas from the beginning of the conversion process to said preselected time during the conversion process, $\epsilon$VO2WG = total volume of unreacted oxygen in the waste gas, $\epsilon$VCOWG = total volume of carbon monoxide in the waste gas, $\epsilon$VO2IN = total volume of oxygen introduced into the stack of air of infiltration, $\epsilon$VO2DA = total volume of oxygen from air of infiltration converted to dust.

* * * * *